United States Patent [19]

Scherz

[11] 4,126,323

[45] Nov. 21, 1978

[54] SKATE BOOT

[76] Inventor: Hans R. Scherz, 228 Prince Albert Ave., Montreal, Quebec, Canada, H3Z 2G6

[21] Appl. No.: 766,674

[22] Filed: Feb. 8, 1977

Related U.S. Application Data

[63] Continuation-in-part of Ser. No. 577,654, May 15, 1975, abandoned.

[51] Int. Cl.[2] ..... A63C 1/26

[52] U.S. Cl. ..... 280/11.12; 36/97

[58] Field of Search ..... 280/11.12, 11.3, 11.36, 280/611; 36/97, 138, 117, 87, 118, 119, 120, 121

[56] References Cited

U.S. PATENT DOCUMENTS

| | | | |
|---|---|---|---|
| 2,523,449 | 9/1950 | Rosenweig | 36/97 |
| 2,572,050 | 10/1952 | Ornstein | 280/11.3 |
| 3,114,562 | 12/1963 | Goodman | 280/611 |
| 3,235,978 | 2/1966 | Hyde | 280/11.36 |
| 3,486,247 | 12/1969 | Franet | 36/117 |
| 3,538,627 | 11/1970 | Labat-Camy | 36/117 |
| 3,748,756 | 7/1973 | White | 36/97 |

FOREIGN PATENT DOCUMENTS

| | | | |
|---|---|---|---|
| 578,840 | 10/1924 | France | 36/97 |
| 465,968 | 5/1937 | United Kingdom | 36/97 |

*Primary Examiner*—David M. Mitchell

*Attorney, Agent, or Firm*—Swabey, Mitchell, Houle, Marcoux & Sher

[57] ABSTRACT

A skate is described having a runner, a boot portion including a sole, support means connecting the runner to the sole, the boot including a forward upper portionof molded construction and a rear heel portion slidably connected with the forward portion for limited relative movement towards and away from the upper portion.

9 Claims, 4 Drawing Figures

21
92
90
10
24
20
86
22
3
32
88
3
84
14
15
50
12

92
88
10
22
24
26
30
48
44
52
14
16
88
15
54
40
46
41a
12
13
18

Fig. 3
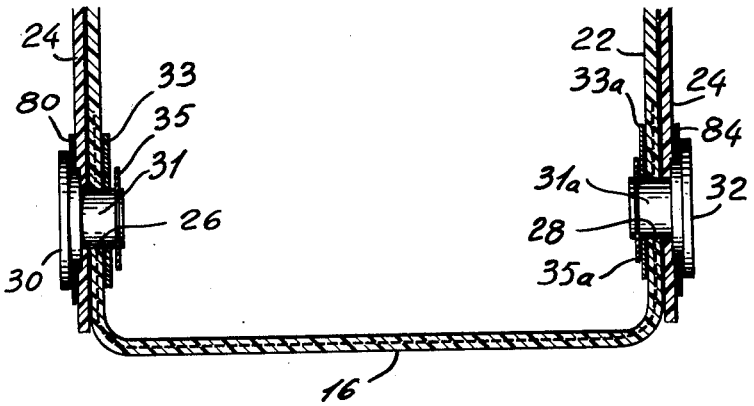
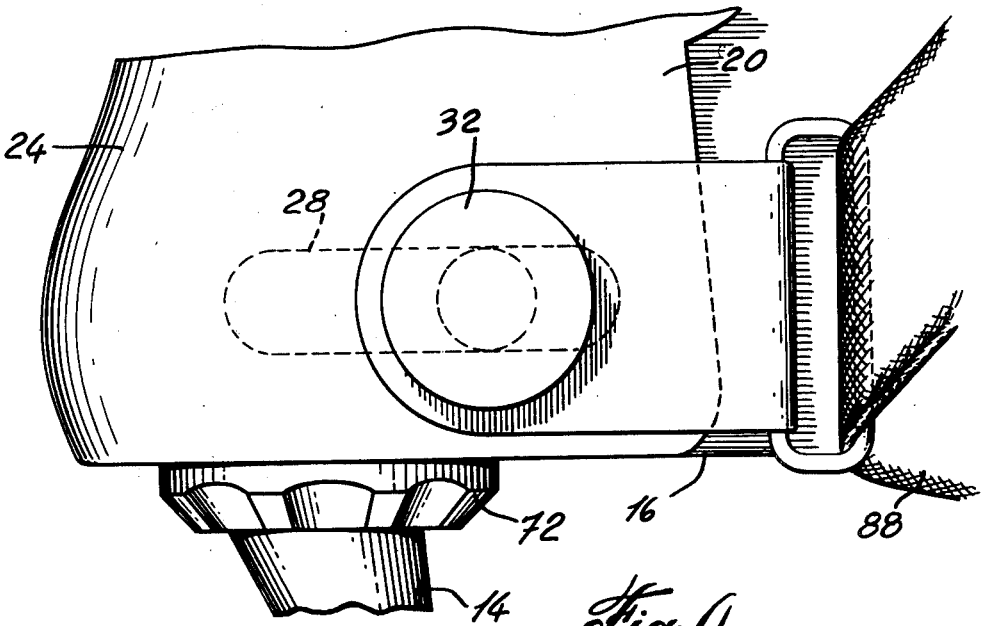
Fig. 4

SKATE BOOT

CROSS-REFERENCE TO RELATED APPLICATION

The present application is a continuation-in-part of application Ser. No. 577,654, filed May 15, 1975 and now abandoned.

BACKGROUND OF THE INVENTION

1. Field of the Invention

The present invention relates to skates, and more particularly, to ice skates.

2. Description of the Prior Art

Ice skates comprise a running blade attached to the sole of an especially adapted boot. Conventionally, the boot is made of leather and is laced from the upper of the boot in order to provide a firm fit about the wearer's foot and ankle. The boot is best reinforced and often has hard plastic protective portions at the toe area and in the heel area to protect the wearer's foot and ankle, particularly in the sport of ice hockey.

In recent years an ice hockey skate has been developed wherein the complete boot was molded from a rigid plastics material. However, although the plastic skate boot has met with acceptance, it has only slight advantages over the conventional leather boot. It offers protection since the shell is rigid, and it provides a firmer support for the ankle. However, the boot must still be laboriously laced, and the firmness of the boot on the wearer's foot depends on the strength and ability of the person lacing the boot to find a proper tension in the lacing which, while maintaining the boot firm on one's foot, would not cut the circulation of blood to the foot. One of the disadvantages in a conventional ice skate boot, be it of plastics material or leather, is that the lacing procedure provides for pressure against the foot from the upper thereby pressing the heel towards the heel of the boot and moving the fore foot portion away from the toe area of the upper. The upper of a boot, however, has a natural wedge shape and the pressure being placed on the upper portion of the foot moves the foot away from this natural wedging action.

Anyone who has ever put on a pair of ice skates knows the trouble and care that must be taken in the proper lacing of the boot in order to get the ultimate skate control. Only the experienced skater can master the proper lacing technique and amount of tension.

SUMMARY OF THE INVENTION

It is an aim of the present invention to provide an ice skate boot which would avoid the necessity of lacing the boot on one's foot.

A further aim of the present invention is to provide a boot of molded plastics material which is rigid and which incorporates the advantages of the molded plastics ski boot but without the disadvantages of conventional lacing as on the present day plastics ice skate boot.

It is a further aim of the present invention to provide a boot in which the foot can be firmly wedged into the natural wedge shape of the upper.

It is a further aim of the present invention to provide an improved detachable runner or blade portion.

A construction in accordance with the present invention includes a skate having a runner, a boot portion including a sole, support means connecting the runner to the sole, the boot including a forward upper portion of molded construction and a rear heel portion slidably connected with the forward upper portion for limited relative movement therewith, and means for fastening the heel portion relative to the upper portion.

In a more specific construction, the present invention includes a skate comprising a boot and a runner, the boot portion including a sole, an upper and a separate heel portion. At least one of the upper and heel portions is affixed to the sole, and means connect the runner to the sole. The upper and sole portions define a tapered foot-receiving recess having the wedge shape of a human foot. The heel portion includes a vertical heel member, and means are provided for connecting the heel portion to the upper for relative limited longitudinal sliding movement between said heel portion and the upper portion. Means are provided for adjustably fastening the heel portion and the upper such that when a foot is inserted in the foot-receiving recess, the fastening means retains the heel portion under pressure against the heel of the foot, thereby wedging the foot in the foot-receiving recess.

What is meant by the word "skate" is any device having a boot or portion in which one's foot may be seated and a runner attached to the sole of the boot, such as an ice skate, roller skate, etc., or even a ski boot to which a ski when attached becomes the runner.

BRIEF DESCRIPTION OF THE DRAWINGS

The invention will now be described in detail having reference to the accompanying drawings, in which:

FIG. 3 is a vertical cross-section taken along lines 3—3 of FIG. 1; and

FIG. 4 is an enlarged fragmentary view of a detail of the boot.

DESCRIPTION OF THE PREFERRED EMBODIMENTS

Figure 1:
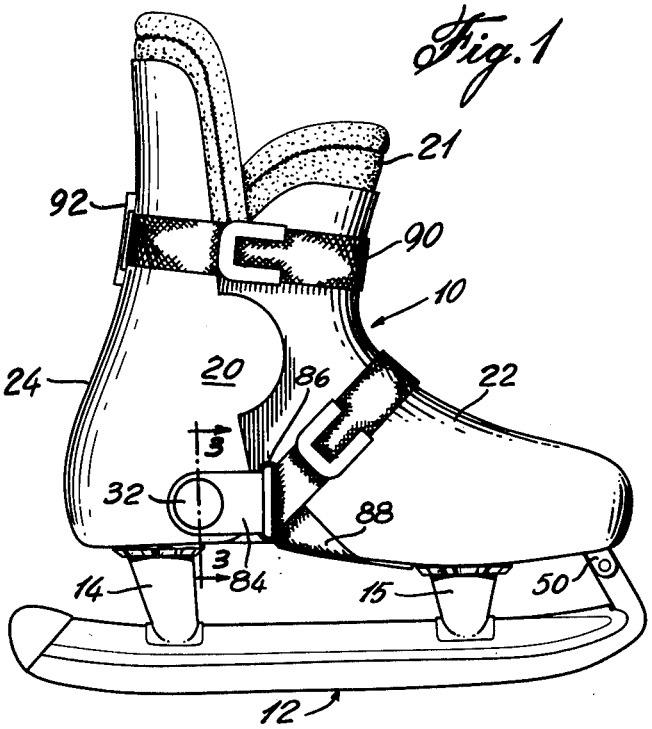
FIG. 1 is a side elevation of one embodiment of a skate having the novel boot construction.
Figure 2:
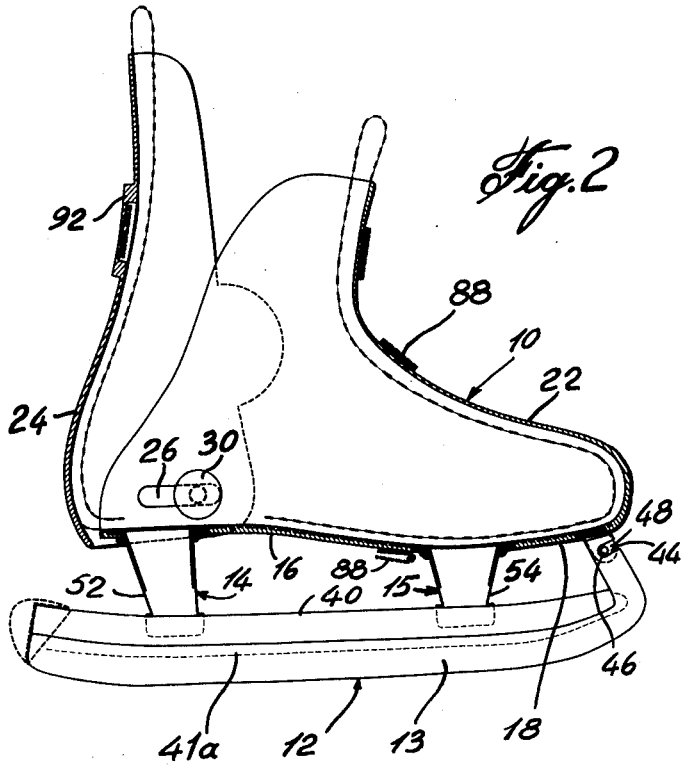
FIG. 2 is a vertical cross-section taken longitudinally of the boot of FIG. 1.

Referring now to the drawings, there is included a skate 10 having a blade 12 and blade supports 14 and 15 connected to the heel 16 and sole 18 respectively. The heel 16 and sole 18 are connected to the heel portion and sole portion of a boot 20. The boot 20 is made up of two molded parts, namely, a boot upper 22 and a boot heel and tendon guard 24. The molded parts 22 and 24 are molded from suitable, relatively rigid, plastic materials, such as those used within present-day ski boots. An insulating liner 21 is provided within the boot. There are slots 26 and 28 provided opposite each other, and a rear portion of the boot upper 22, as shown in FIGS. 1 and 2. The heel and tendon guard portion 24 is provided with flanged pins 30 and 32 which slide within the slots 26 and 28 respectively. The upper 22 is shown in the drawings as being fixed to the sole and heel portion of the boot 20. However, it is obvious that the heel portion 24 could be fixed to the heel and sole portion of the boot 20 while the upper could be adapted to slide relative to the fixed heel portion 24.

In the cross-section shown in FIG. 3, the flanged pins 30 and 32 are shown in detail. Referring to flange 30, there is provided a shank 31 which extends through and is fixed to the wall of the heel and tendon portion 24 but which is adapted to slide in the slot 26 formed in the wall of the upper 22. A washer 33 can be located on the inside of the boot, and the shank can be held therein by means of a lock washer 35. Similar elements in flanged pin 32 are referred to with the subscript A.

A metal holder 80 is fixed to the shank 31 of the pin 30 and includes a loop 82 as will be described hereunder. Similarly, a metal holder 84 is fixed to the flanged pin 32 and mounts a loop 86. A strap 88 may be clamped or fixed to the sole portion 18 and passes through the loop 86 as shown in FIG. 1 and FIG. 4. The other end of the strap passes through loop 82 (not shown) and is adapted to be buckled with the end of the strap 88 passing through the loop 86 as shown in the drawing.

A strap 90 passes about the heel and tendon portion 24 through a loop 92 and can be fastened together at the top front of the upper 22 as shown in FIG. 1.

In operation, the heel and tendon guard portion 24 is moved rearwardly against the edges of the slots 26 and 28 and can be pivoted in a counterclockwise manner to allow a foot to be inserted into the boot 20. Once a foot is inserted in the boot, the heel and tendon guard portion 24 is simply slid back so that the inner liner 21 comfortably contacts the rear heel portion of the wearer's foot. In order to firmly tighten the boot about the wearer's foot, the straps 88 and 90 are simply buckled and tightened in a conventional manner thereby moving the heel and tendon guard portion against the heel and Achilles tendon portion of the foot wedging the foot into the upper 22.

I claim:

1. A boot for a skate having a runner, the boot including a sole, an upper, and a separate heel portion, at least one of the upper and heel portions being fixed to the sole, means connecting the runner to the sole, the upper having a pair of side walls, the upper and sole portion defining a tapered foot-receiving recess having a wedge shape of a human foot, said heel portion including a vertical heel member with a pair of side walls overlapping side walls of the upper, means connecting said heel portion to said upper permitting relative limited longitudinal sliding movement and pivoting movement between said heel portion and said upper, said means including cooperating connectors in the respective side walls of the upper and heel portion, and fastening means for adjustably fastening said heel portion and said upper such that when a foot is inserted in the foot-receiving recess, said fastening means retains said heel portion under pressure against the heel of said foot thereby wedging the foot in said foot-receiving recess.

2. A boot for a skate as defined in claim 1, wherein the upper and sole portions of the boot are affixed defining a front boot portion and the heel portion slides longitudinally relative to said front boot portion.

3. A skate as defined in claim 2, wherein the heel includes a tendon guard portion and the upper, heel and tendon guard portion comprise molded rigid plastics material.

4. A skate as defined in claim 3, wherein the sole is integrally connected with the upper, and the heel and tendon guard portion are a separate molded piece.

5. A skate as defined in claim 1, wherein the means slidably connecting the heel portion to the upper includes a pair of opposed slots, one in each side wall of the upper, and a sliding flange pin fixed to each side wall of the heel portion receiving said slots defined in the upper.

6. A skate as defined in claim 5, wherein the fastening means includes a strap fixed to the upper and passing through connecting means fixed to the heel so that upon tightening of the strap, the heel is drawn towards the upper.

7. A skate as defined in claim 6, wherein the flange pin has mounted thereon a bracket holder, said connecting means comprising a loop on said bracket holder, said strap passing through said loop.

8. A skate as defined in claim 6, wherein a soft form fitting liner is provided within the upper and heel and tendon guard portion to receive the foot.

9. A boot for a skate having a runner, the boot including a sole, an upper having opposed side walls, and a heel portion having side walls overlapping with said upper side walls, means connecting the runner to the sole, the upper and heel portions being separate, the upper being affixed to the sole, means slidably connecting the separate heel portion and the upper for limited relative longitudinal movement toward and away from each other, and means for fastening the heel portion and the upper together, said means slidably connecting the heel portion to the upper including a pair of opposed slots, one in each side wall of the upper, and a sliding flanged pin fixed to each side wall of the heel portion receiving said slots defined in the upper.

* * * * *